United States Patent [19]

Warncke

[11] 3,935,861

[45] Feb. 3, 1976

[54] PROTECTIVE BREATHING MASK WITH COMPRESSED AIR SUPPLY FOR BREATHING

[75] Inventor: Ernst Warncke, Lubeck, Germany

[73] Assignee: Drägerwerk Aktiengesellschaft, Germany

[22] Filed: July 1, 1974

[21] Appl. No.: 484,880

[30] Foreign Application Priority Data

July 14, 1973 Germany ..... 2336047

[52] U.S. Cl. ..... 128/142 R; 128/142.2; 128/146.7

[51] Int. Cl.[2] ..... A62B 7/00

[58] Field of Search ..... 128/142–142.4, 128/145 R, 140 R, 140 A, 145.6, 146.3–146.7, 141 R, 146; 2/171.3, 206

[56] References Cited

UNITED STATES PATENTS

| | | | |
|---|---|---|---|
| 1,288,647 | 12/1918 | Miller | 128/145 R |
| 2,444,393 | 6/1948 | Woo | 128/142.3 |
| 2,882,896 | 4/1959 | Seeler | 128/142.2 |
| 3,018,776 | 1/1962 | Saitta et al. | 128/142.4 |
| 3,149,632 | 9/1964 | Colley | 128/142.2 |
| 3,167,070 | 1/1965 | Silverman | 128/145.6 |
| 3,343,535 | 9/1967 | Lytle et al. | 128/141 R |
| 3,348,538 | 10/1967 | Benzel | 128/142 |
| 3,680,555 | 8/1972 | Warncke | 128/141 R |
| 3,833,935 | 9/1974 | Ansite et al. | 128/142 |

FOREIGN PATENTS OR APPLICATIONS

| | | | |
|---|---|---|---|
| 480,473 | 2/1938 | United Kingdom | 128/141 R |
| 802,211 | 6/1936 | France | 128/142.4 |

*Primary Examiner*—Robert W. Michell
*Assistant Examiner*—Henry J. Recla
*Attorney, Agent, or Firm*—McGlew and Tuttle

[57] ABSTRACT

A protective breathing mask comprises a face encircling mask body which is connected to a compressed gas line for the supply of compressed gas thereto. The mask includes an encircling rim portion which defines an air seal cavity and it is provided with a passage in the body or separated from the body which is connected to the compressed gas line for supplying gas into the seal cavity. The rim includes an inner lip which engages over the face of the wearer and the gas which is circulated to the cavity escapes between the lip and the face into the mask interior. The gas conduit advantageously includes a lung demand inlet valve which opens into the front or into one side of the mask and which has a by pass passage through a throttle to the seal cavity. The seal cavity is advantageously defined by an outwardly formed annular bead or by an annular tubular member which may for example have openings around its periphery for directing the compressed gas from the cavity into the mask interior.

5 Claims, 3 Drawing Figures

PROTECTIVE BREATHING MASK WITH COMPRESSED AIR SUPPLY FOR BREATHING

BACKGROUND OF THE INVENTION

1. FIELD OF THE INVENTION

This invention relates in general to the construction of breathing masks and in particular to a new and useful mask for use with compressed gas which includes an annular rim forming a seal cavity which is supplied with at least a portion of the compressed gas which escapes between the seal and the wearer's face into the interior of the mask.

2. DESCRIPTION OF THE PRIOR ART

The penetration of noxious substances into the interior space of a breathing mask must be prevented at the seal of the mask rim. The mask rim is to be designed so as to obtain a seat of the mask on the user's skin as comfortable as possible.

There are known protecting breathing masks having a double seal rim, in which the interspace between the seal rim is washed by exhaled air. Also protecting breathing masks having inflatable seals are known.

Another protecting breathing mask is known as disclosed in U.S. Pat. No. 3,167,070 in which, in order to insure an impeccable seal, the wall of the mask is provided with a dual seal rim. The inner seal rim is made of a porous material with closed cells which is impermeable for gas while the outer seal rim is made of a porous material having cells which are not tightly closed but rather provided with openings so that air and gas may pass therethrough. The interspace formed between the seal rims communicates, through a conduit and a gas filter, with a source of compressed air. An electrically driven air pump is used as the source of compressed air. A quantity of about 15 to 20 l/min of air is continuously pressed by the air supply device into the space between the two seal rims whereby a small overpressure is maintained in this space. Through the porous outer seal rim, air can continuously escape from the interspace to the outside and thereby prevent the penetration of noxious substances contained in the ambient air from entering into the space between the seal rims. This applies also in cases when, while using the protecting breathing mask, underpressure is produced in the interior of the mask during inhalation and air is taken into the interior of the mask from the space between the seal rims, if the seat of the inner gastight seal rim is not satisfactory. For operation, the known mask requires a source of compressed air in the form of an electrically driven pump, as well as electric energy. The wash air supplied through the pump must be purified in a filter before entering the space between the seal rims. There is no other way for preventing the endangering of the user. The expensively supplied and cleaned air escapes through the porous outer seal rim to the outside and is thus lost for the breathing.

There is further known a protecting breathing mask having a double seal rim and provided with an exhaling valve which is connected in parallel to the space between the two seal rims and opens directly to the open air and whose resistance is adjusted so that a part of the exhaling air flows directly into the peripheral space which communicates with the outside air through at least one outlet comprising a check valve. In this protecting breathing mask, the space between the two seal rims is practically permanently filled with exhaling air. Consequently, at any leakage between the seal rims and the skin surface of the user of the mask, only exhaling air is taken into the interior of the mask from the space between the seal rims, due to the underpressure produced by inhalation. The inmost seal rim may be designed as a seal lip extending in the direction of the space between the two seal rims. In spite of the two seal rims and the washing with the exhaling air this mask must be carefully adjusted. Even if the seal rim is designed as a seal lip, only the underpressure produced by inhalation can be used as the contact pressure and thereby seal pressure. To securely prevent the penetration of the outer air into the interior, the wash air volume and thus the space between the seal rims must be large.

In known smoke masks, an inflatable air tube is used for drilling the interspace between the rim of the mask and the user's head and sealing the interior of the mask against the outside air after being inflated. The inflation is effected by means of a small air pump communicating with the seal tube through a flexible tube extending through the interior of the mask. In this device, the seal tube after it is inflated has to provide for the sealing. It is recommended to use a neck strap in addition in order to prevent the seal tube from slipping off the user's face. The sealing is effected by contact pressure along a sealing line following the face. The seal tube is inflated by an additional, hindering device suspended from the mask and, moreover, it is necessary to permanently check if the contact pressure is sufficient for the sealing.

SUMMARY OF THE INVENTION

The invention provides a protecting breathing mask with compressed air supply for the breathing, having a seal at the mask rim in the form of a cavity through which air is circulated. The seal prevents in a constructionally simple manner the surrounding air, which may be noxious, from penetrating into the interior of the mask through leakage points at the rim of the mask. In addition, the handling and maintenance of the mask is simple. In accordance with the invention, a partial stream of the compressed air is supplied to the cavity extending along the rim of the mask, through a throttle and a gas conduit. In one application of the invention, the cavity at the mask rim is formed by mutually parallel seal rims known per se. In this advantageous application of the invention, a continuous washing with breathable, fresh air is effected in the space between the two seal rims. A throttle is arranged in a partial stream of the gas and the desired partial quantity of compressed air passing therethrough is determined thereby in a simple manner and independently of the compressed air supply. The partial flow is adjusted so that a small overpressure is permanently maintained between the seal rims and the wash air passes both to the interior, through the inner seal rim, and to the outside, through the outer seal rim. At the same time, a particular design of the seal rims as lips insures that selectively, a certain portion of the air passes inwardly into the mask space and a certain portion to the outside. With a breathing air quantity of from between 30 and 90 l/min, the branching of a partial flow of some 3 to 5 l/min is of little importance for the total air supply. It is, however, very important for the seal security which is considerably increased.

In another application of the invention, the cavity at the rim of the mask is a cavity seal known per se, provided with outlet openings. The openings lead to the interior of the mask. The advantage of the invention resides in that in the inflated state of the seal, air is still continuously circulated therethrough so that the seal instantly adapts to any stress and follows the movements of the user's face along the sealing line. By choosing an appropriate number and size of the openings as well as their arrangement, the air quantity of the partial stream is controlled. The stream may be directed so as to first flow against the sight windows, which prevents the latter from becoming fogged by moisture.

According to a development of the invention, in a protecting breathing mask provided with a compressed gas inlet valve controlled by the breathing, the compressed gas partial stream furnished to the cavity is branched to a partial flow passage in advance of the compressed gas inlet valve. The advantages of the invention are appreciable particularly in protecting breathing masks having a breath-controlled compressed gas inlet valve. In such masks, the partial stream of the compressed gas can be channeled directly from the pressure side of the valve up to the cavity, along a path within or outside the mask or the mask body. The expenses of manufacture are very small and the same applies to the susceptibility to disturbances. In accordance with still another development of the invention, a compressed gas inlet valve is provided which is controlled by the breathing and can be detachably connected to the mask, the component part supporting the valve, and the protecting breathing mask, are provided with gas conduits which, upon coupling of the compressed gas inlet valve to the mask, establish a communication between the compressed gas supply line and the cavity. The connection of the breath-controlled compressed gas inlet valve can be fixed only after the communication between the compressed gas supply and the cavity has been established. In this case, it is very useful to insure that the breath-controlled compressed gas valve cannot be coupled to the mask before the establishing of the pressure-tight connection of the partial stream conduit.

An advantageous embodiment of the invention includes a gas conduit incorporated in the mask body.

The protecting breathing mask designed in accordance with the invention may generally be applied to all types of protecting breathing devices operating with compressed air as the breathing air. Even a protecting breathing hood can be reliably sealed off if, for example, a double seal rim is applied against the neck by means of an elastic seal ring having two lips and the space therebetween is passed through by an air flow.

Accordingly it is an object of the invention to provide a protective breathing mask which comprises a face encircling mask body which has a connection thereto for supplying compressed gas to the interior of the mask and which includes an encircling rim which defines an air seal cavity which is connected by passage means to the compressed gas line so that at least a partial flow of the gas flows into the cavity at a pressure to cause a portion to escape to the interior of the mask and outwardly to the exterior.

A further object of the invention is to provide a protective breathing mask which is simple in design, rugged in construction and economical to manufacture.

For an understanding of the principles of the invention, reference is made to the following description of typical embodiments thereof as illustrated in the accompanying drawing.

GENERAL DESCRIPTION OF PREFERRED EMBODIMENTS

Figure 1:
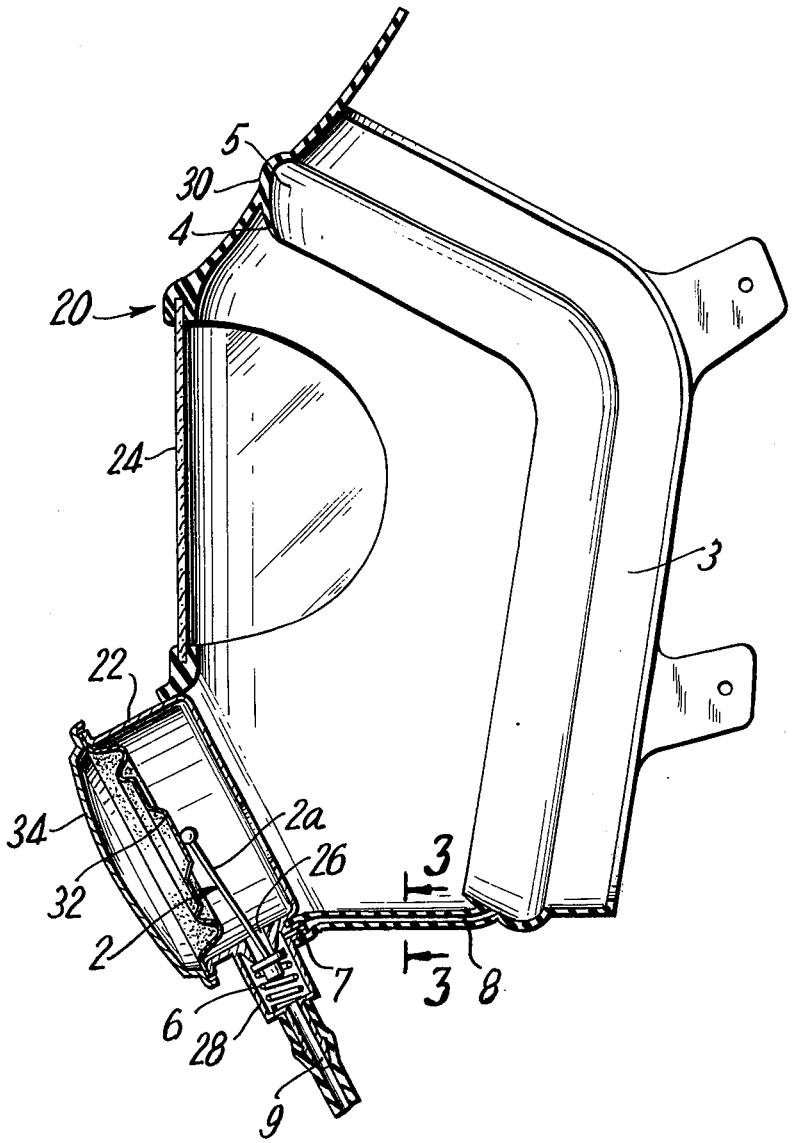
FIG. 1 is a sectional view through a gas breathing mask of a type operable on a compressed gas supply and constructed in accordance with the invention.

Referring to the drawings in particular the invention embodied therein in FIGS. 1 and 3 comprises a face encircling gas mask body generally designated 20 which has a front inlet fitting 22 provided below a viewing window 24 which carries an inlet valve generally designated 2 which is biased onto an inlet seat 26 by a spring 6 carried in a valve chamber 28 of a gas supply conduit 9.

In accordance with the invention a portion of the gas which flows through the supply conduit 9 passes into a passage 8 having a throttle 7 therein for regulating the quantity of flow. This gas in the passage 8 passes through an annular sealing cavity 5 defined between an encircling rim 30 of the mask body and the wearer's face. The cavity 5 includes a double seal rim designed as an outer lip 3 and an inner lip 4. The cavity 5 communicates with the pressure side of the gas conduit 9 through the passage 8 for the partial stream of the gases thereto. The valve member 2 includes an elongated arm portion **2*a* which is directed against a diaphragm 32 which is closed by a cover 34.**

The flow through the compressed gas passage 9 and past the valve seat 26 into the mask and flow through the throttle 7 and into the passage 8 is regulated so that the cavity is continuously washed by a quantity of the gas and a portion thereof escapes between the inner lip 4 and the wearer's face to the interior of the mask and also through the outer lip 3 to the outside. Lips 4 and 3 thus act as valves in the sense that they regulate the escape and flow of the circulated air. The escape of the air at the sealing rim interior and exterior provides an air flow at locations which are most critical in respect to the sealing of the mask.

Figure 2:
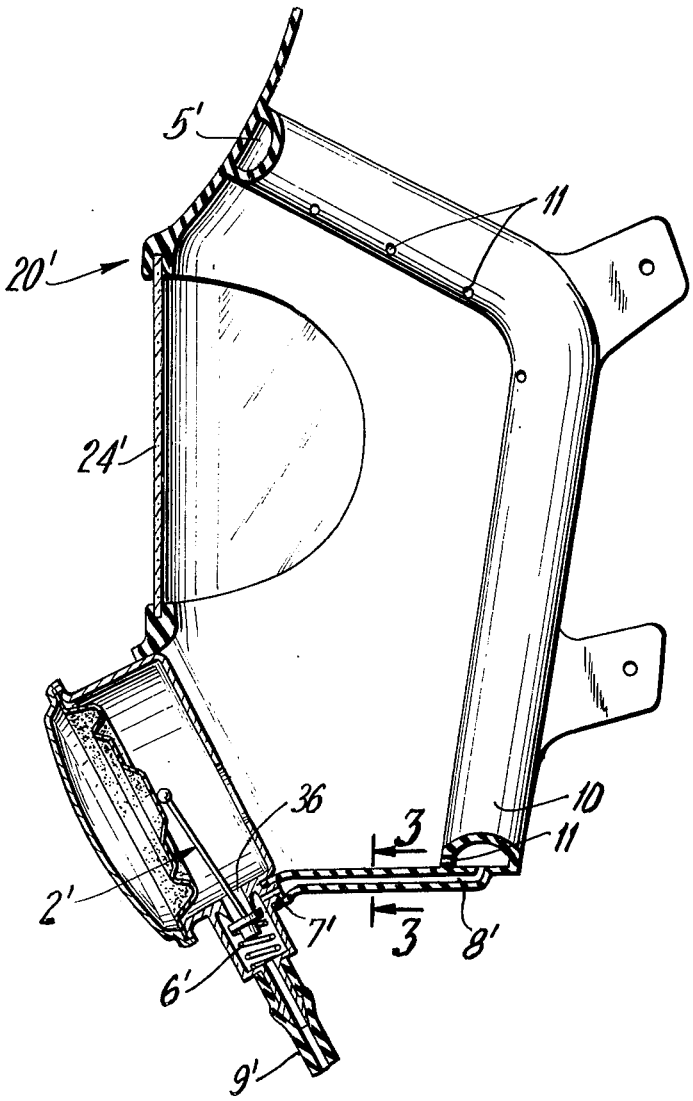
FIG. 2 ia a view similar to FIG. 1 of another embodiment of the invention.

In the embodiment shown in FIG. 2 a mask body 20′ includes similar parts which are similarly designated but with primes. In this embodiment a seal cavity 5′ is defined by an inflatable tube 10 which comprises an annular tube forming a rim at the periphery of the mask body 20′. Tube 10 is provided with a plurality of openings 11 around its periphery to permit the escape of the compressed gas or air therethrough. In this embodiment the compressed gas is supplied through a compressed gas conduit 9′ and the flow of gas into an inlet 36 past the valve body 2′ is controlled by the setting of a spring 6′ and also by a throttle 7′ in a passage 8′. The outlet openings 11 are located so that air escapes to the interior of the mask. They are advantageously spaced so that a partial quantity of the escaped air is first directed against the sight window 24′.

When the mask of the embodiment shown in FIG. 5 is placed on the wearer's face the encircling banded portion or tube 10 may be positioned loosely over the face before tightening. The tightening may be effected by inflating the tube to cause the rim to tighten against the person's face. Thus with the encircling band already pulled up in place, the the sealed rim will then apply more tightly to the face due to the inflation pressure.

In each of the embodiments an underpressure is produced in the mask space by inhalation so that the diaphragm 32 is displaced to the right hand side. When this occurs the rocker arm 2*a* is also displaced in the direction of the diaphragm motion. This causes it to move the valve disc 28 which is secured to the arm 2*a* so that it tips away from the valve seat 26 and the compressed air can flow to the mask space and thus to the respiratory ducts. As a general proposition an exhaling valve for instance (not shown) is provided for reevacuating the exhaled air.

Figure 3:
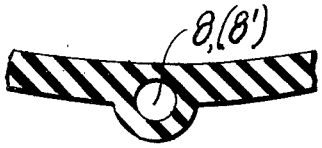
FIG. 3 is a section taken on the lines 3—3 of FIG. 1 as well as on 3—3 of FIG. 2.

The partial sectional view of the wall of the mask body 20′ shown in FIG. 3 indicates that the gas conduit 8 as well as the gas conduit 8′ may be defined directly in the mask material.

While specific embodiments of the invention have been shown and described in detail to illustrate the application of the principles of the invention, it will be understood that the invention may be embodied otherwise without departing from such principles.

What is claimed is:

1. A protective breathing mask comprising a face encircling mask body, a compressed gas line connected into the interior of said mask body, said mask body having an encircling rim portion defining an air seal cavity, a tubular conduit defined in a wall of said mask and forming a partial flow gas passage extending from said gas line to said cavity, and throttle means in said partial gas passage for permitting a flow of compressed gas into the cavity in a quantity which will permit some escape of gas from the cavity.

2. A protective mask according to claim 1, wherein said compressed gas line connected to the front of said mask has a spring operated inlet valve, said partial passage being connected to said gas conduit on the pressure side of said inlet valve.

3. A mask according to claim 2, wherein said inlet valve includes a diaphragm portion at the front of said mask body and a valve member having an arm portion resting against said diaphragm and spring biasing said valve member to a closed position.

4. A protective breathing mask according to claim 1, wherein said gas line includes an inlet valve at the connection thereof to the front of said mask body, said valve being detachably connected to said mask body, said valve being set so that when compressed gas inlet is coupled to the mask there is a communication between the compressed gas line and said cavity.

5. A protective breathing mask according to claim 4, wherein said valve can be fixed only after establishing the communication between said compressed gas supply and said cavity.

* * * * *